United States Patent [19]

Zorn et al.

[11] 3,945,829

[45] Mar. 23, 1976

[54] COLOR PHOTOGRAPHIC MULTILAYER MATERIAL WITH IMPROVED COLOR DENSITY

[75] Inventors: Hugo Zorn, Munich-Lochhausen; Karl Küffner, Unterhaching; Hans Glockner, Munich, all of Germany; Jozef Frans Willems, Wilrijk; Robrecht Julius Thiers, Brasschaat, both of Belgium

[73] Assignee: AGFA-Gevaert Aktiengesellschaft, Leverkusen, Germany

[22] Filed: July 15, 1974

[21] Appl. No.: 488,438

[30] Foreign Application Priority Data

July 19, 1973 Germany ..... 2336721

[52] U.S. Cl. ..... 96/74; 96/84 R; 96/109; 96/120; 260/308 R; 260/302 R

[51] Int. Cl.[2] .. G03C 1/84; G03C 1/76; G03C 1/34; G03C 1/02

[58] Field of Search ..... 96/109, 84 R, 74, 94 BF, 96/1.6, 1.7, 120; 160/302 R

[56] References Cited

UNITED STATES PATENTS

| | | | |
|---|---|---|---|
| 2,220,187 | 11/1940 | Wilmanns et al. | 96/74 |
| 2,231,127 | 2/1941 | Kendall | 96/109 |
| 2,336,327 | 12/1943 | Weissberger et al. | 96/74 |
| 2,464,798 | 3/1949 | Duerr et al. | 96/74 X |
| 2,533,514 | 12/1950 | Sandey et al. | 96/74 X |
| 2,534,599 | 12/1950 | Howe | 96/109 |
| 2,865,748 | 12/1958 | Feniak et al. | 96/74 X |
| 3,342,597 | 9/1967 | Harnish et al. | 96/74 X |

*Primary Examiner*—David Klein
*Assistant Examiner*—Alfonso T. Suro Pico
*Attorney, Agent, or Firm*—Connolly and Hutz

[57] ABSTRACT

Heterocyclic mercapto compounds are added to a binder layer containing colloidal silver which is comprised in a color photographic multilayer material. The colloidal silver layer may be a yellow filter layer to prevent exposure of the green, and red recording layers to blue light, or an antihalation layer arranged between the layer support and the lowermost light sensitive silver halide emulsion layer. The heterocyclic mercapto compounds reduce the contact fog produced in the (first) developer and increase color density in reversal processing. Additionally there can be present in the colloidal silver layer a sensitizer for the blue, green or red spectral region.

5 Claims, No Drawings

COLOR PHOTOGRAPHIC MULTILAYER MATERIAL WITH IMPROVED COLOR DENSITY

This invention relates to a multilayer color photographic silver halide material comprising at least one binder layer which contains colloidal silver and in addition a heterocyclic mercapto compound to prevent the so-called contact fog produced during processing at the colloidal silver of said binder layer.

Color photographic films are provided, for various purposes, with filter layers which contain colloidal silver. These filter layers are arranged adjacent to individual light-sensitive emulsion layers, for example the auxiliary layer between the blue sensitive and the green sensitive silver halide layer and may contain yellow colloidal silver. This yellow filter layer serves to keep the unwanted blue component of light away from the red and green sensitive emulsion layers. The layer which functions as antihalation layer between the support layer and the silver halide layer directly adjacent to it may contain black, brown or blue colloidal silver. Colored colloidal silver may also be incorporated in a covering layer to correct the color reproduction.

These various layers which contain colloidal silver frequently have a deleterious effect on the adjacent emulsion layers, particularly if the color materials are treated with developers which contain complex forming substances for the silver halide in the emulsion layers, such as alkali metal thiocyanate or amino compounds or substantial quantities of sulfites and alkali metal halides. These complex forming compounds may cause physical development to take place at the nuclei of colloidal silver in the auxiliary layers. This has the effect of increasing the color fog in color negative materials and the quantity of fogging silver in the first developer in the case of color reversal materials so that the color density obtained by subsequent color forming development is correspondingly reduced. These disadvantageous phenomena are known as contact fog. The measures previously used to prevent contact fog have various disadvantages. For example the incorporation of separating layers which contain gelatine between the layer which contains colloidal silver and the light sensitive silver halide emulsion layers only incompletely prevented the formation of contact fog and had the added disadvantage of reducing the sharpness of the image.

Attempts to reduce the contact fog by the action of reducing agents on colloidal silver (see Grechko and Wilenski, Sci. et Ind. phot. 2, 32, page 437) also had no useful practical result. In some cases, such attempts even led to fogging and desensitization of adjacent emulsion layers.

Derivatives of benzothiazole and benzoselenazole have been described in U.S. Pat. No. 3,206,310 as additives added to colloidal silver to prevent contact fog. These substances, however, are only effective if they can react with the colloidal silver solution for some time at a given pH before casting. It is assumed that the benzo thiazole or benzoselenazole ring is decomposed by hydrolysis to form a free thiol compound which is regarded as the active substance which prevents contact fog.

It is an object of this invention to prevent the formation of contact fog in auxiliary layers which contain colloidal silver. According to the invention, this is achieved by the fact that, in a color photographic multilayered material which comprises several light-sensitive silver halide emulsion layers arranged above one another which contain color couplers and at least one light insensitive layer of binder which contains colloidal silver (for example a silver filter layer), the said layer of binder contains, per g of silver, 0.1 to 1 g of a heterocyclic mercapto compound in which a heterocyclic group comprising a 5-membered or 6-membered heterocyclic ring carries a mercapto group preferably via a ring carbon atom. The heterocyclic group may have other rings condensed to the heterocyclic ring and may also carry photographic inert substituents, i.e. a water-solubilizing group or an aliphatic hydrocarbon group containing from 8 to 20 carbon atoms, which aliphatic group confers diffusion resistance. In the heterocyclic mercapto compounds which can be used according to the invention the heterocyclic ring preferably contains at least one nitrogen atom, and preferably one of such ring nitrogen atoms is bonded via a double bond to a ring carbon atom which carries the mercapto group.

Compounds which are derived from mercaptopyrimidine, mercaptotriazole, mercaptothiazolinone or mercaptobenzimidazole have been found to be particularly suitable. Owing to the possibilities of tautomerism, a considerable proportion of the compounds may also be present as tautomeric thioxo compounds and the compounds are therefore also formulated as such.

The following are given as examples of particularly suitable heterocyclic mercapto (or thioxo) compounds:

1 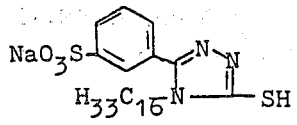

2 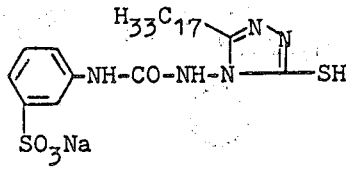

3 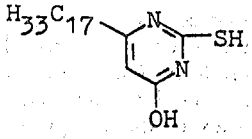

4 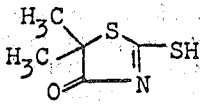

5 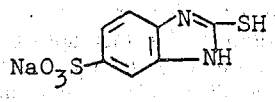

6 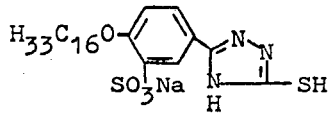

7 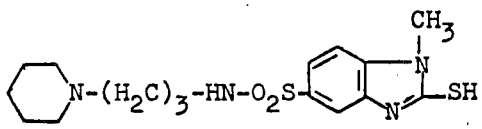

8 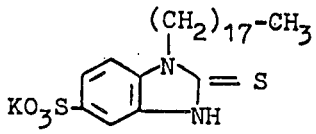

9 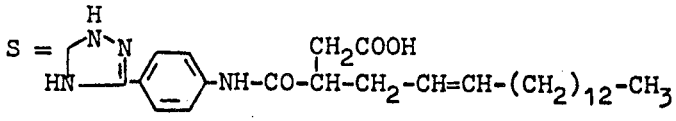

10 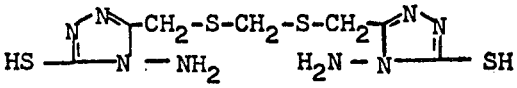

11 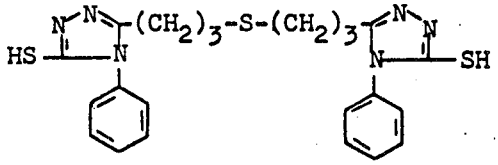

The efficiency of the compounds according to the invention in preventing contact fog depends on their adsorption on colloidal silver, a property which can be determined by suitable tests. The lower the adherence of the mercapto compound to the silver grain, the stronger is the tendency of the compound to diffuse from the original layer during casting, storage or development of the colour material and impair the colour reproduction in the adjacent emulsion layer. Compounds which are substituted on the ring system with aliphatic hydrocarbon groups which contain 8 to 20 carbon atoms are therefore preferred on account of their reduced tendency to migrate into other layers. The concentration of mercapto compounds is preferably between 0.1 and about 1 g per g of silver. The compounds are generally added to the silver colloid before casting. In a particular embodiment of the invention and in addition to the mercapto compounds according to the invention sensitizing dyes which are known for sensitizing silver halide emulsions for the blue, green or red spectral region as described in German Offenlegungsschrift No. 2,314,514 may be added to the silver colloid. These dyes may be, for example, monomethine or trimethine cyanines or merocyanines. The proportion of mercapto compound to sensitizing dye may vary within wide limits according to the choice of compounds. When preparing the multilayered material, it is simplest if the dye which is added to the filter layer is one which is also used for sensitizing the adjacent silver halide emulsion layer. The preparation of various types of colloidal silver has been described in the literature, e.g. in Weiser, Colloidal Elements, Wiley & Sons, New York, 1933, in which the preparation of yellow colloidal silver by the dextrin reduction method of Carey and Lea is described, or in German Patent Specification No. 1,096,193 (colloidal brown and black silver) and in U.S. Pat. No. 2,688,601 (colloidal blue silver). The color photographic silver halide material is built up in known manner by applying the silver halide emulsions in several layers on the support layer.

At least three emulsion layers of differing spectral sensitivities are arranged above one another. The support layer is usually covered successively with a red sensitive layer which contains cyan coupler, a green sensitive layer which contains magenta coupler and a blue sensitive layer which contains yellow coupler. The yellow filter layer which contains yellow colloidal silver is normally situated between the blue sensitive layer and the green sensitive layer, a heterocyclic mercapto compound being added according to the invention to this yellow filter layer, either alone or together with a sensitizing dye. In certain types of film, a layer of binder which contains brown or black colloidal silver may also be arranged as antihalation layer adjacent to the support layer. This layer of binder may also contain the additives mentioned above.

The following Examples serve to explain the invention in detail.

EXAMPLE 1

Increasing quantities of mercapto compound 1 were added to an aqueous dispersion of yellow colloidal silver in gelatine, known as silver yellow according to Carey Lea, the quantities added being, respectively 0 mg, 250 mg and 750 mg to 150 g of silver yellow which corresponded to 1 g of metallic silver. After the addition of a wetting agent and hardener, the three silver yellow dispersions were cast on a support layer of cellulose acetate in thicknesses corresponding to an application of 0.2 g of silver per $m^2$. A blue sensitive emulsion layer which builds up the yellow partial image was cast on each of the three silver yellow layers in the same way as is customary in a normal color film. This blue sensitive emulsion layer consisted of a silver iodobromide emulsion of medium sensitivity containing 5 mols % of AgI, α-(2-tetradecycloxybenzoyl)-acetanilide as yellow forming coupler and the usual stabilizers, plasticizers, wetting agents and hardeners.

A test strip from each of the three samples was treated as follows:

A. An unexposed strip was fixed and washed.

B. An unexposed strip was developed for 12 minutes at 24°C in the first developer described below and then fixed and washed.

C. A strip exposed behind a sensitomer wedge was subjected to a complete color reversal process as described below.

1. First development of 12 minutes at 24°C in a thiocyanate containing Metol-hydroquinone developer of the following composition:

| | |
|---|---|
| Ethylene diaminotetracetic acid sodium | 2 g |
| p-N-monomethylaminophenolsemisulfate | 4 g |
| Sodium sulfite | 50 g |
| Hydroquinone | 6 g |
| Sodium carbonate | 35 g |
| Sodium thiocyanate | 1.5 g |
| Potassium bromide | 2 g |
| Potassium iodide | 10 mg |
| Benzotriazole | 250 mg |
| made up with water to | 1000 ml |
| pH 10.0 ± 0.1 | |

2. Washing - 5 minutes

3. Second exposure - 1 minute

4. Reversal development - 15 minutes at 24°C in a colour developer of the following composition:

| | |
|---|---|
| Nitrilotriacetic acid | 2 g |
| Sodium sulfite | 5 g |

-continued

| | |
|---|---|
| Hydroxylamine sulfate | 1 g |
| Trisodium phosphate | 20 g |
| Potassium bromide | 1 g |
| Potassium iodide | 10 mg |
| 4-Amino-3-methyl-N-ethyl-N-(β-methylsulfonamidoethyl)-anilinosesquisulfate monohydrate | 9 g |
| Ethylenediamine 50 % | 6 ml |
| made up with water to | 1000 ml |
| pH 12.0 | |

The material was then clarified, bleached, fixed and washed in the usual manner.

The treated strips, which have been colored yellow either by the colloidal silver or by the dye, were examined in a Macbeth densitometer behind a blue filter. The following results, which are characteristic of the invention, were obtained.

| | |
|---|---|
| DB (fixed): | Yellow density of the strip which has been fixed according to A |
| DB (developed): | yellow density of the strip which has been developed according to B |
| D max.: | maximum yellow density of the yellow color density curve obtained according to C |
| Es: | specific sensitivity of the yellow color density curve obtained according to C. Es = log I.t for the color density $\frac{D\ max. + Es}{2}$ where Es is the color fog resulting from total exposure. |

The density difference ΔDB = DB (developed) — DB (fixed) is a measure of the quantity of silver deposited on the silver yellow in the first developer.

The values for D max. and Es indicate to what extent the reduction in the quantity of silver deposited on the yellow filter which is achieved by the substances claimed according to the invention has an effect on the maximum density of the yellow dye and the photographic sensitivity.

| Addition of Compound 1 in mg/g of Ag | 0 | 250 | 750 |
|---|---|---|---|
| ΔDB | 2.51 | 1.70 | 0.78 |
| Dmax | 2.65 | 2.72 | 2.86 |
| Es | 2.62 | 2.61 | 2.58 |

It can be seen that the addition of the mercapto compound greatly reduces the quantity of silver deposited on the silver yellow in the first developer and considerably increase the color density of the yellow layer while the specific sensitivity is only insignificantly reduced.

EXAMPLES 2 – 5

Compound 2, 3, 4 or 5 was added to the silver yellow instead of the additive used in Example 1. The individual samples, which contain increasing quantities of mercapto compound, where treated and examined as described in Example 1.

| Addition of Compound 2 in mg/g Ag | 0 | 250 | 750 |
|---|---|---|---|
| Δ DB | 2.43 | 2.00 | 1.21 |
| Dmax | 2.66 | 2.69 | 2.86 |
| Es | 2.75 | 2.69 | 2.66 |
| **Addition of Compound 3 in mg/g Ag** | **0** | **250** | **750** |
| Δ DB | 2.65 | 2.46 | 0.40 |
| Dmax | 2.55 | 2.55 | 3.01 |

-continued

| Addition of Compound 2 in mg/g Ag | 0 | 250 | 750 |
|---|---|---|---|
| Es | 2.54 | 2.51 | 2.49 |
| Addition of Compound 4 in mg/g Ag | 0 | 250 | 750 |
| Δ DB | 2.63 | 1.00 | 0.87 |
| Dmax | 2.50 | 2.58 | 2.75 |
| Es | 2.66 | 2.51 | 2.43 |
| Addition of Compound 5 in mg/g Ag | 0 | 250 | 750 |
| Δ DB | 2.51 | 1.76 | 1.42 |
| Dmax | 2.55 | 2.77 | 2.75 |
| Es | 2.66 | 2.51 | 2.41 |

EXAMPLE 6

Compound 1 and 5,5′-chloro-3,3′-di-(β-carboxyethyl)-9-ethyl-benzothiazole carbocyanine iodide (Dye 1) were added to the silver yellow separately and in combination instead of the substances added in Example 1. The individual samples were treated and examined as described in Example 1.

| Addition in mg/g of Ag of Compound 1 | — | 500 | — | 250 | 300 |
|---|---|---|---|---|---|
| Dye 1 | — | — | 125 | 125 | 125 |
| Δ DB | 2.50 | 0.91 | 1.41 | 0.58 | 0.16 |
| Dmax | 2.60 | 2.66 | 2.62 | 2.69 | 2.78 |
| Es | 2.51 | 2.48 | 2.48 | 2.46 | 2.47 |

EXAMPLE 7

Increasing quantities of the mercapto compound from Example 1, namely 0 mg, 115 mg and 230 mg, based on 1 g of metallic silver in the slver black dispersion, were added to an aqueous dispersion of black-brown colloidal silver in gelatine (silver black) which had been prepared by the reduction of silver nitrate and hydrazine. The three samples were prepared, treated and examined as described in Example 1 with the only difference that a red sensitive emulsion layer was applied to the silver black dispersion to build up the cyan partial image. It contains a silver iodobromide emulsion of medium sensitivity with 5 mols % of silver iodide and 6 g of 1-hydroxy-N-octadecyl-2-naphthamide per 6 g of emulsion.

The three samples of these layer combinations were exposed behind a sensitometer wedge, subjected to the process of color reversal development described in Example 1 and examined to assess their Dmax and Es (specific sensitivity).

| Addition of compound 1 in mg/g of black Ag | 0 | 115 | 230 |
|---|---|---|---|
| Dmax | 3.14 | 3.22 | 3.26 |
| Es | 2.64 | 2.65 | 2.65 |

EXAMPLE 8

Varying quantities of the combination of mercapto compound 2 and dye 1 were added to the silver black instead of the substances added in Example 1.

The samples were treated and examined as described in the previous examples.

| Addition in mg/g of Ag: | | | | | |
|---|---|---|---|---|---|
| Compound 2 | — | 115 | — | 58 | 115 |
| Dye 1 | — | — | 11 | 11 | 11 |
| Dmax | 3.23 | 3.30 | 3.33 | 3.60 | 3.63 |
| Es | 2.76 | 2.77 | 2.79 | 2.74 | 2.74 |

EXAMPLE 9

The arrangement of layers in the material corresponds to that of Example 1 with the addition of mercapto compound 1 to the yellow filter in a quantity of 0.8 g/g of yellow silver in contrast to the blank sample. The material was subjected to a process of color negative development as follows:

| | | |
|---|---|---|
| 1. Color negative developer 14 minutes at 24°C | | |
| Sodium hexametaphosphate | 2 | g |
| $Na_2SO_3$ sicc. | 2 | g |
| Potassium bromide | 2.5 | g |
| Sodium metaborate | 80 | g |
| 4-Amino-3-methyl-N-ethyl-N-(β-methanesulfonamidoethyl)-aniline-sesquisulfate monohydrate | 6 | g |
| Benzyl alcohol | 6 | ml |
| made up with water to | 1000 | ml |
| pH | 10.8 | |
| 2. Short stop bath 4 minutes at 24°C | | |
| Sodium acetate | 5 | g |
| Glacial acetic acid | 20 | ml |
| made up with water to | 1000 | ml |
| pH | 3.9 | |
| 3. Hardening bath 4 minutes at 24°C | | |
| Formalin 30 % | 18 | ml |
| Sodium carbonate | 20 | g |
| made up with water to | 1000 | ml |
| pH | 10.6 | |
| 4. Washing 4 minutes at 24°C | | |
| 5. Bleaching bath 6 minutes at 24°C | | |
| Potassium ferricyanide | 35 | g |
| Boric acid | 10 | g |
| Borax | 7 | g |
| Potassium bromide | 10 | g |
| Potassium nitrate | 30 | g |
| made up with water to | 1000 | ml |
| pH | 8.3 | |
| 6. Washing 6 minutes at 24°C | | |
| 7. Fixing bath 8 minutes at 24°C | | |
| Sodium thiosulfate | 320 | g |
| Sodium sulfite | 6 | g |
| Sodium bisulfite | 4 | g |
| made up with water to | 1000 | ml |
| pH | 7.0 | |
| 8. Final washing 10 minutes | | |

| Addition of mercapto compound 1 in g/g of yellow silver | Blank sample (0) | 0.8 |
|---|---|---|
| Color fog | 0.26 | 0.14 |
| Gradation | 0.76 | 0.86 |
| Sensitivity (0.1 above fog) | standard | +0.10 |

The addition of the mercapto compound to the silver yellow reduces the color fog in the adjacent emulsion layer in the process of color negative development while the threshold sensitivity and gradation are slightly increased.

What is claimed is:

1. A color photographic multi-layer material having compounds that produce an image by image-wise exposure followed by developing treatment producing an image comprising at least two spectrally sensitized silver halide emulsion layers each containing a color coupler and at least one other layer containing a binder and colloidal silver, wherein the improvement comprises the binder and colloidal silver layer contains a non-diffusible heterocyclic mercapto compound carrying a substituent consisting of an aliphatic hydrocarbon group having 8 to 20 carbon atoms and a mercapto group on a ring carbon atom of a 5- or 6- membered heterocyclic ring, said heterocyclic mercapto compound being in an amount of 0.1 to 1 g per g of colloidal silver.

2. Color photographic multilayer material as claimed in claim 1, wherein the mercapto compound is a mercapto pyrimidine, mercapto triazole, mercapto thiazolinone or mercapto benzimidazole.

3. Color photographic multilayer material as claimed in claim 1, wherein a layer of binder which contains yellow colloidal silver as a yellow filter layer, contains a non-diffusible sensitizer for the blue, green or red spectral region.

4. Color photographic multilayer material as claimed in claim 1 wherein the layer comprising the binder and colloidal silver contains black colloidal silver, the non-diffusible heterocyclic mercapto compound and a sensitizer for the red spectral region and said binder and colloidal silver layer is arranged between a layer support and an adjacent silver halide emulsion layer which contains cyan-forming coupler.

5. The photographic material as claimed in claim 1 in which the heterocyclic mercapto compound the heterocyclic ring contains at least one nitrogen atom and at least one ring nitrogen atom is bonded by a double bond to the ring carbon which carries the mercapto group.

* * * * *